US010803850B2

(12) United States Patent
Li et al.

(10) Patent No.: US 10,803,850 B2
(45) Date of Patent: Oct. 13, 2020

(54) VOICE GENERATION WITH PREDETERMINED EMOTION TYPE

(71) Applicant: Microsoft Technology Licensing, LLC, Redmond, WA (US)

(72) Inventors: Chi-Ho Li, Beijing (CN); Baoxun Wang, Beijing (CN); Max Leung, Beijing (CN)

( * ) Notice: Subject to any disclaimer, the term of this patent is extended or adjusted under 35 U.S.C. 154(b) by 378 days.

(21) Appl. No.: 14/480,611

(22) Filed: Sep. 8, 2014

(65) Prior Publication Data

US 2016/0071510 A1 Mar. 10, 2016

(51) Int. Cl.
*G10L 13/027* (2013.01)
*G10L 25/63* (2013.01)

(52) U.S. Cl.
CPC ..... *G10L 13/027* (2013.01); *G10L 25/63* (2013.01)

(58) Field of Classification Search
None
See application file for complete search history.

(56) References Cited

U.S. PATENT DOCUMENTS 6,151,571 A 11/2000 Pertrushin
6,826,530 B1 * 11/2004 Kasai ..... G10L 13/047 704/258
7,912,720 B1 3/2011 Hakkani-Tur et al.
8,214,214 B2 7/2012 Bennett
8,412,530 B2 4/2013 Pereg et al.
2005/0060158 A1 * 3/2005 Endo ..... G10L 15/22 704/275
2005/0114137 A1 * 5/2005 Saito ..... G10L 13/10 704/260
2005/0273339 A1 * 12/2005 Chaudhari ..... G10L 15/26 704/270
2009/0177475 A1 * 7/2009 Kato ..... G10L 13/06 704/260

(Continued)

FOREIGN PATENT DOCUMENTS

DE 102005010285 A1 9/2006
WO 2003073417 A2 9/2003

OTHER PUBLICATIONS

Metze, et al., "Fusion of Acoustic and Linguistic Features for Emotion Detection", In Proceedings of IEEE International Conference on Semantic Computing, Sep. 14, 2009, 8 pages.

*Primary Examiner* — Richa Mishra
(74) *Attorney, Agent, or Firm* — Shook, Hardy & Bacon, LLP

(57) ABSTRACT

Techniques for generating voice with predetermined emotion type. In an aspect, semantic content and emotion type are separately specified for a speech segment to be generated. A candidate generation module generates a plurality of emotionally diverse candidate speech segments, wherein each candidate has the specified semantic content. A candidate selection module identifies an optimal candidate from amongst the plurality of candidate speech segments, wherein the optimal candidate most closely corresponds to the predetermined emotion type. In further aspects, crowd-sourcing techniques may be applied to generate the plurality of speech output candidates associated with a given semantic content, and machine-learning techniques may be applied to derive parameters for a real-time algorithm for the candidate selection module.

18 Claims, 10 Drawing Sheets

(56) References Cited

U.S. PATENT DOCUMENTS

2009/0265170 A1* 10/2009 Irie ..... G10L 17/26
704/236
2011/0208522 A1* 8/2011 Pereg ..... G06F 17/279
704/235
2013/0211838 A1* 8/2013 Park ..... G10L 13/10
704/260
2014/0074478 A1* 3/2014 Ahrens ..... G10L 13/08
704/260
2014/0379352 A1* 12/2014 Gondi ..... G10L 25/63
704/271
2015/0371626 A1* 12/2015 Li ..... G10L 13/00
704/260

* cited by examiner 410.1

| Semantic content 310 | Associated emotionally diverse candidates 500 |
|---|---|
| Red Sox have won World Series (501a) | Candidate 1, Candidate 2, …, Candidate N (510A.1, 510A.2, …, 510A.N) |
| ⋮ | ⋮ |

FIG 5

VOICE GENERATION WITH PREDETERMINED EMOTION TYPE

BACKGROUND

Field

The disclosure relates to computer generation of voice with emotional content.

Background

Computer speech synthesis is increasingly prevalent in the human interface capabilities of modem computing devices. For example, modem smartphones may offer an intelligent personal assistant interface for a user of the smartphone, providing services such as answering user questions and providing reminders or other useful information. Other applications of speech synthesis may include any system in which speech output is desired to be generated, e.g., personal computer systems delivering media content in the form of speech, automobile navigation systems, systems for assisting people with visual impairment, etc.

Prior art techniques for generating voice may employ a straight text-to-speech conversion, in which emotional content is absent from the speech rendering of the underlying text. In such cases, the computer-generated voice may sound unnatural to the user, thus degrading the overall experience of the user when interacting with the system. Accordingly, it would be desirable to provide efficient and robust techniques for generating voice with emotional content to enhance user experience.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Briefly, various aspects of the subject matter described herein are directed towards techniques for generating speech output having emotion type. In one aspect, an apparatus includes a candidate generation block configured to generate a plurality of candidates associated with a message, and a candidate selection block configured to select one of the plurality of candidates as corresponding to a predetermined emotion type. The plurality of candidates preferably span a diverse emotional content range, such that a candidate having emotional content close to the predetermined emotion type will likely be present.

In one aspect, the plurality of candidates associated with a message may be generated offline via, e.g., crowd-sourcing, and stored in a look-up table or database associating each message with a corresponding plurality of candidates. The candidate generation block may query the look-up table to determine the plurality of candidates. Furthermore, the candidate selection block may be configured using predetermined parameters derived from a machine learning algorithm. The machine learning algorithm may be trained offline using training messages having known emotion types.

Other advantages may become apparent from the following detailed description and drawings.

BRIEF DESCRIPTION OF THE DRAWINGS

FIG. 5 showing a candidate generation block implemented as a look-up table (LUT).

DETAILED DESCRIPTION

Various aspects of the technology described herein are generally directed towards a technology for generating voice with emotional content. The techniques may be used in real time, while nevertheless drawing on substantial human feedback and algorithm training that is performed offline.

It should be understood that the embodiments, aspects, concepts, structures, functionalities or examples described herein are non-limiting, and the present invention may be used in various ways to provide benefits and advantages in text-to-speech systems in general. For example, exemplary techniques for generating a plurality of emotionally diverse candidates and for selecting a candidate matching the specified emotion type are described, but any other techniques for performing similar functions may be used.

The detailed description set forth below in connection with the appended drawings is intended as a description of exemplary aspects of the invention and is not intended to represent the only exemplary aspects in which the invention can be practiced. The term "exemplary" used throughout this description means "serving as an example, instance, or illustration," and should not necessarily be construed as preferred or advantageous over other exemplary aspects. The detailed description includes specific details for the purpose of providing a thorough understanding of the exemplary aspects of the invention. It will be apparent to those skilled in the art that the exemplary aspects of the invention may be practiced without these specific details. In some instances, well-known structures and devices are shown in block diagram form in order to avoid obscuring the novelty of the exemplary aspects presented herein.

Figure 1:
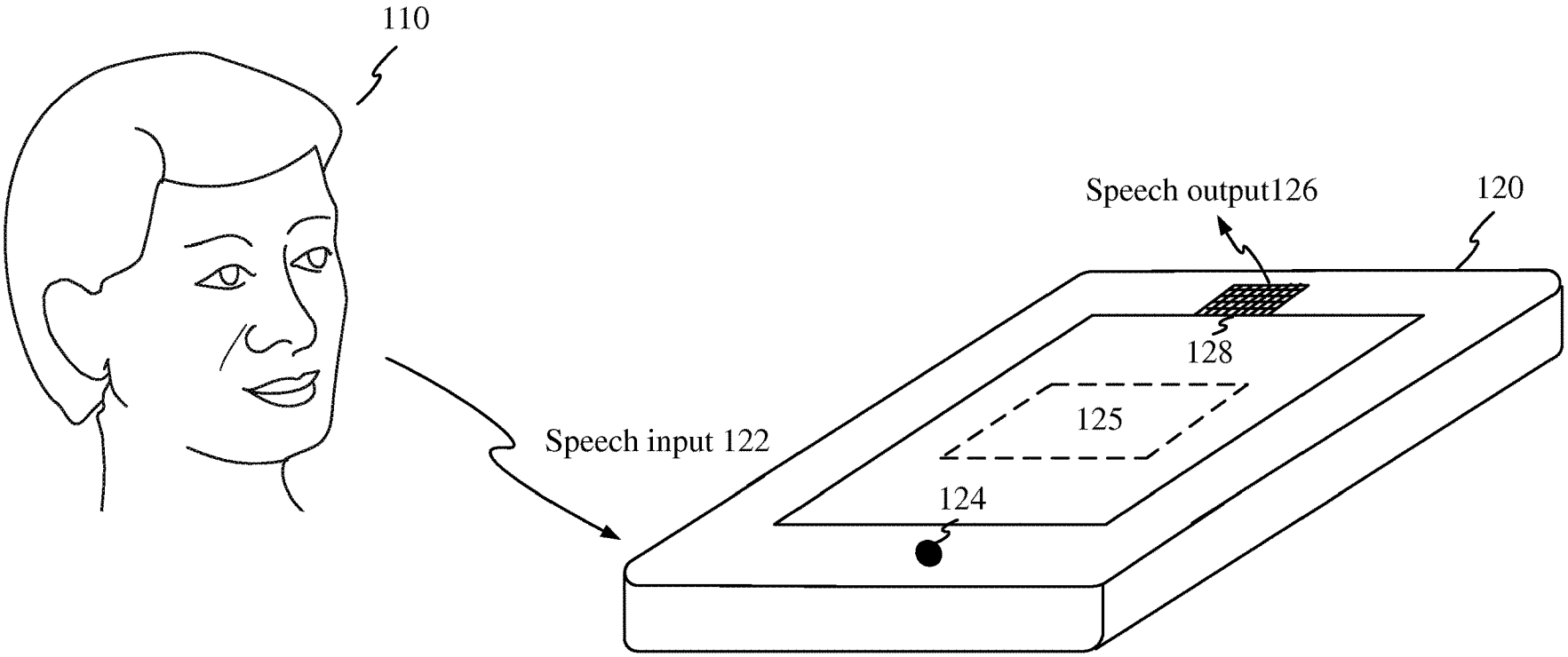
FIG. 1 illustrates a scenario employing a smartphone wherein techniques of the present disclosure may be applied.

FIG. 1 illustrates a scenario employing a smartphone wherein techniques of the present disclosure may be applied. Note FIG. 1 is shown for illustrative purposes only, and is not meant to limit the scope of the present disclosure to only the application shown. For example, techniques described herein may readily be applied in scenarios other than those utilizing smartphones, e.g., notebook and desktop computers, automobile navigation systems, etc. Such alternative exemplary embodiments are contemplated to be within the scope of the present disclosure.

In FIG. 1, user 110 communicates with computing device 120, e.g., a handheld smartphone. User 110 may provide speech input 122 to microphone 124 on device 120. One or more processors 125 within device 120 may process the speech signal received by microphone 124, e.g., performing functions as further described with reference to FIG. 2 hereinbelow. Note processors 125 for performing such functions need not have any particular form, shape, or partitioning.

Based on the processing performed by processor 125, device 120 may generate speech output 126 responsive to speech input 122, using speaker 128. Note in alternative processing scenarios, device 120 may also generate speech output 126 independently of speech input 122, e.g., device 120 may autonomously provide alerts or relay messages from other users (not shown) to user 110 in the form of speech output 126.

Figure 2:
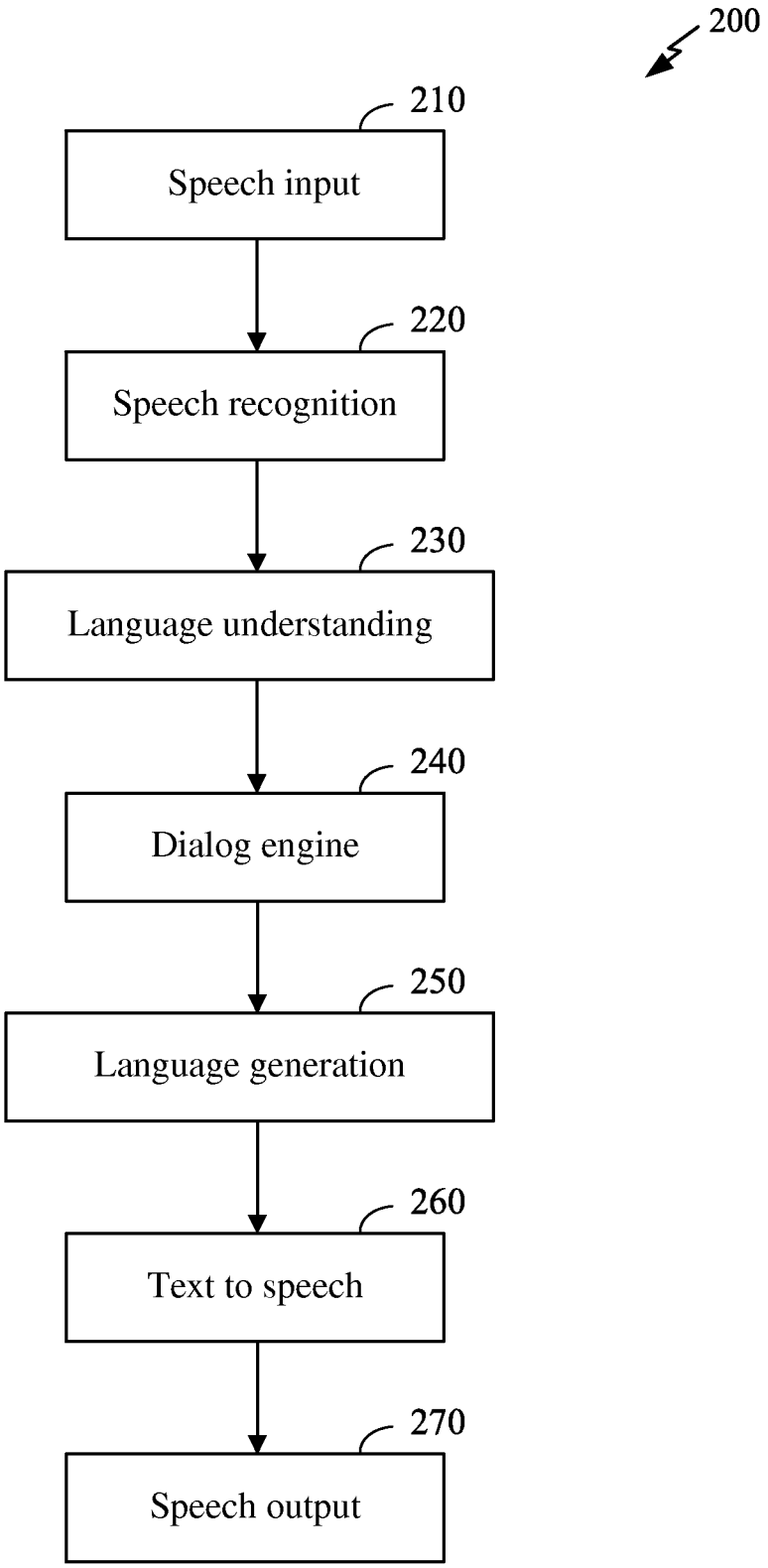
FIG. 2 illustrates an exemplary embodiment of processing that may be performed by processor and other elements of device.

FIG. 2 illustrates an exemplary embodiment of processing 200 that may be performed by processor 125 and other elements of device 120. Note processing 200 is shown for illustrative purposes only, and is not meant to restrict the scope of the present disclosure to any particular sequence or set of operations shown in FIG. 2. For example, in alternative exemplary embodiments, certain techniques for generating emotionally diverse candidate outputs and/or identifying candidates having predetermined emotion type as described hereinbelow may be applied independently of the processing 200 shown in FIG. 2. Furthermore, one or more blocks shown in FIG. 2 may be combined or omitted depending on specific functional partitioning in the system, and therefore FIG. 2 is not meant to suggest any functional dependence or independence of the blocks shown. Such alternative exemplary embodiments are contemplated to be within the scope of the present disclosure.

In FIG. 2, at block 210, speech input is received. Speech input 210 may be derived, e.g., from microphone 124 on device 120, and may correspond to, e.g., audio waveforms as received from microphone 124.

At block 220, speech recognition is performed on speech input 210. In an exemplary embodiment, speech recognition 220 converts speech input 210 into text form, e.g., based on knowledge of the language in which speech input 210 is expressed.

At block 230, language understanding is performed on the output of speech recognition 220. In an exemplary embodiment, natural language understanding techniques such as parsing and grammatical analysis may be performed to derive the intended meaning of the speech.

At block 240, a dialog engine generates a suitable response to the user's speech input as determined by language understanding 230. For example, if language understanding 230 determines that the user speech input corresponds to a query regarding a weather forecast for a particular location, then dialog engine 240 may obtain and assemble the requisite weather information from sources, e.g., a weather forecast service or database.

At block 250, language generation is performed on the output of dialog engine 240. Language generation presents the information generated by the dialog engine in a natural language format, e.g., obeying lexical and grammatical rules, for ready comprehension by the user. The output of language generation 250 may be, e.g., sentences in the target language that convey the information from dialog engine 240 in a natural language format. For example, in response to a query regarding the weather, language generation 250 may output the following text: "The weather today will be 72 degrees and sunny."

At block 260, text-to-speech conversion is performed on the output of language generation 250. The output of text-to-speech conversion 260 may be an audio waveform.

At block 270, speech output in the form of an acoustic signal is generated from the output of text-to-speech conversion 260. The speech output may be provided to a listener, e.g., user 110 in FIG. 1, by speaker 128 of device 120.

In certain applications, it is desirable for speech output 270 to be generated not only as an emotionally neutral rendition of text, but further for speech output 270 to include specified emotional content when delivered to the listener. In particular, a human listener is sensitive to a vast array of cues indicating the emotional content of speech segments. For example, the perceived emotional content of speech output 270 may be affected by a variety of parameters, including, but not limited to, speed of delivery, lexical content, voice and/or grammatical inflection, etc. The vast array of parameters renders it particularly challenging to artificially synthesize natural sounding speech with emotional content. Accordingly, it would be desirable to provide efficient yet reliable techniques to generate speech having emotional content.

Figure 3:
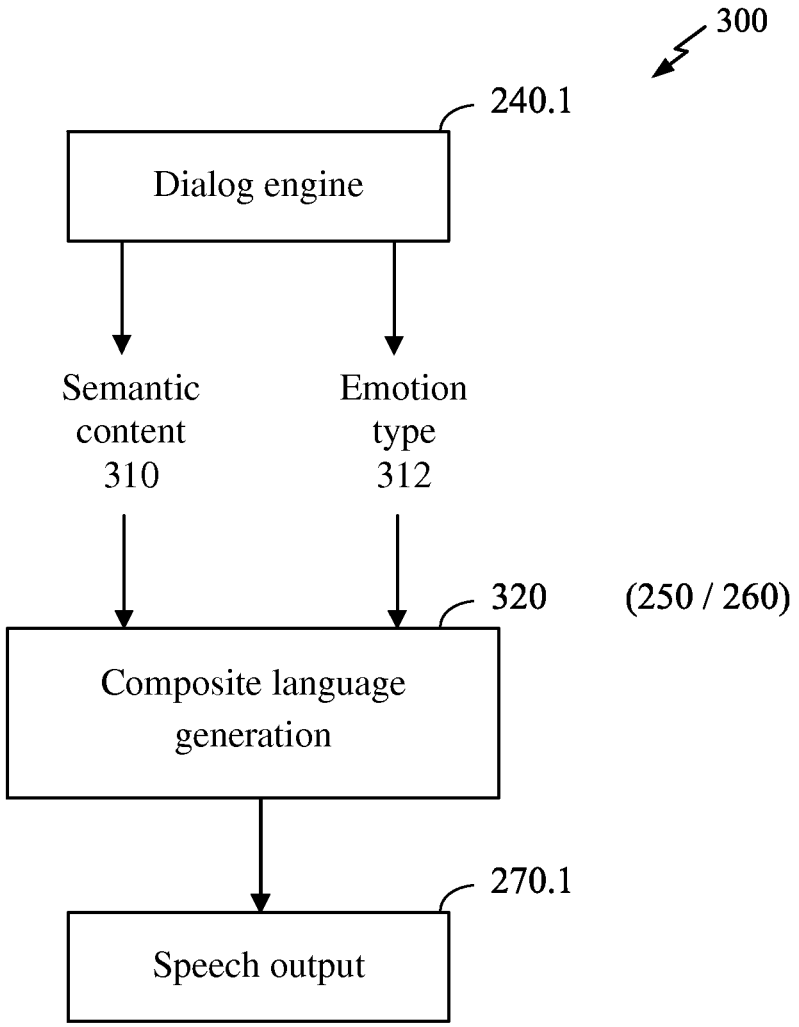
FIG. 3 illustrates an exemplary embodiment of portions of processing that may be performed to generate speech output with emotional content.

FIG. 3 illustrates an exemplary embodiment of processing 300 that may be performed to generate speech output with emotion type. Note certain blocks in FIG. 3 will perform analogous functions to similarly labeled blocks in FIG. 2. Further note that the techniques described hereinbelow need not rely on generation of semantic content 310 or emotion type 312 by a dialog engine 240.1, i.e., in response to speech input by a user. It will be appreciated that the techniques will find application in any scenario wherein voice generation with emotional content is desired, and wherein semantic content 310 and predetermined emotion type 312 are specified.

In FIG. 3, an exemplary embodiment 240.1 of dialog engine 240 generates two outputs: semantic content 310 (also denoted herein as a "message"), and emotion type 312. Semantic content 310 may include, e.g., a message or sentence constructed to convey particular information as determined by dialog engine 240.1. For example, in response to a query for sports news to device 120 by user 110, dialog engine 240.1 may generate semantic content 310 indicating that "The Red Sox have won the World Series." In certain exemplary embodiments, semantic content 310 may be generated with neutral emotion type.

It will be appreciated that semantic content 312 may be represented in any of a plurality of ways, and need not correspond to a full, grammatically correct sentence in a natural language such as English. For example, alternative representations of semantic content may include semantic representations employing abstract formal languages for representing meaning.

Emotion type 312, on the other hand, may indicate an emotion to be associated with the corresponding semantic content 310, as determined by dialog engine 240.1. For example, in certain circumstances, dialog engine 240.1 may specify the emotion type 312 to be "excited." However, in other circumstances, dialog engine 240.1 may specify the emotion type 312 to be "neutral," or "sad," etc.

Semantic content 310 and emotion type 312 generated by dialog engine 240.1 are provided to a composite language generation block 320. In the exemplary embodiment shown, block 320 may be understood to perform both the functions of language generation block 250 and text-to-speech block 260 in FIG. 2. The output of block 320 corresponds to speech output 270.1 having emotional content.

Figure 4:
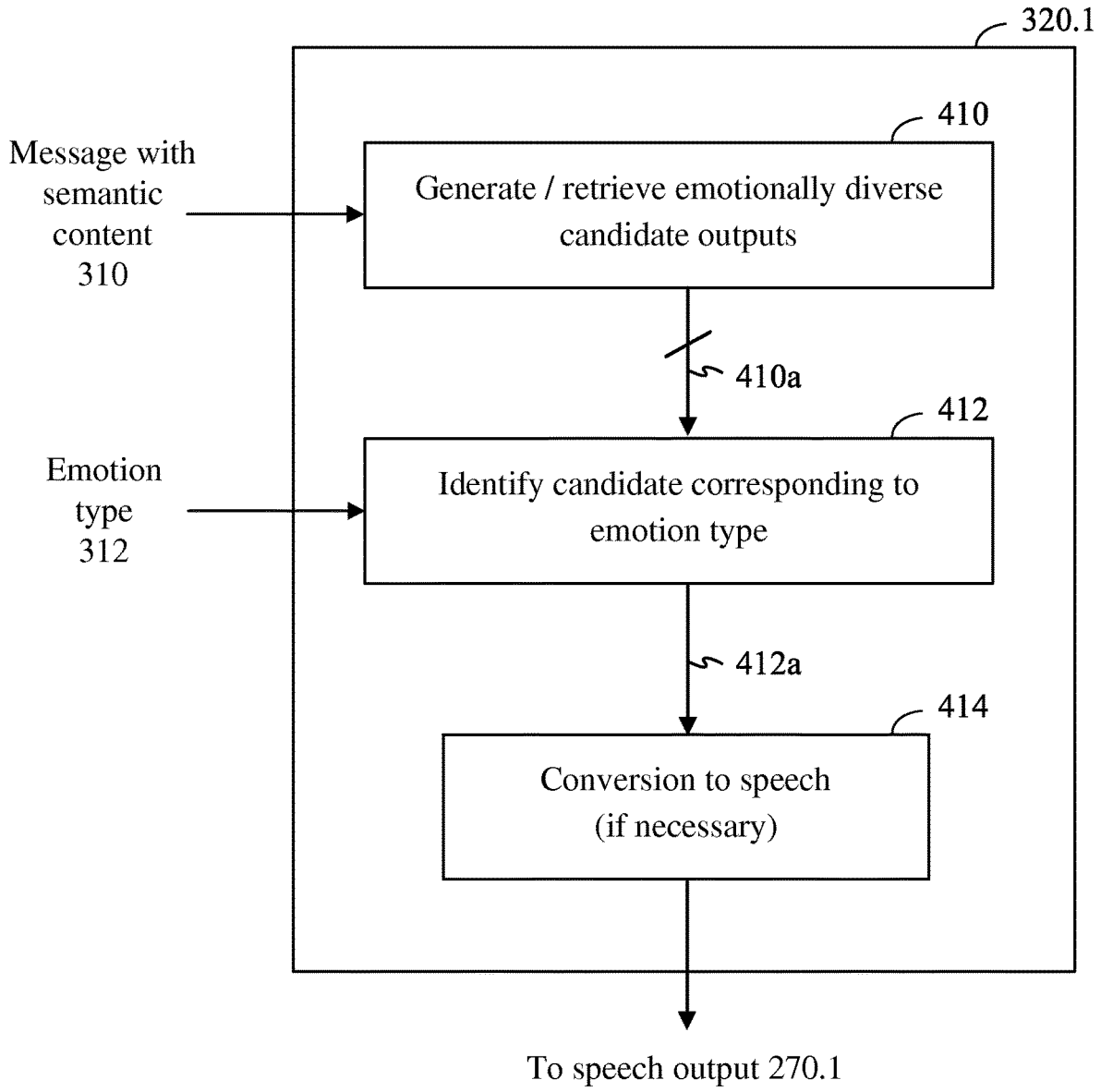
FIG. 4 illustrates an exemplary embodiment of a composite language generation block.

FIG. 4 illustrates an exemplary embodiment 320.1 of composite language generation block 320. Note FIG. 4 is shown for illustrative purposes only, and is not meant to limit the scope of the present disclosure to any particular implementation of composite language generation block 320.

In FIG. 4, composite language generation block 320.1 includes a candidate generation block 410 for generating emotionally diverse candidate outputs 410*a* from a message having predetermined semantic content 310. In particular, block 410 outputs a plurality of candidate speech segments 410*a*, each candidate segment conveying the semantic content 310. At the same time, each candidate segment further has emotional content preferably distinct from other candidate segments. In other words, a plurality of candidate speech segments 410*a* are generated to express the identical semantic content 310 with a preferably diverse range of emotions. In an exemplary embodiment, the plurality of candidate speech segments 410*a* may be retrieved from a database containing a plurality of pre-generated candidates associated with the specific semantic content 310.

For example, returning to the sports news example described hereinabove, candidate speech segments corresponding to the particular semantic content 310 of "The Red Sox have won the World Series" may include the following:

TABLE I

| Candidate speech segment | Text content | Heuristic characteristics of candidate speech segment |
|---|---|---|
| #1 | The Red Sox have won the World Series. | Monotone delivery, normal speed |
| #2 | Wow, the Red Sox have won the World Series! | Loud, fast speed |
| #3 | The Red Sox have finally won the World Series. | Monotone delivery, normal speed |
| #4 | The Red Sox have won the World Series. | Drawn-out delivery, slow speed |

In Table I, the first column lists the identification numbers associated with four candidate speech segments. The second column provides the text content of each candidate speech segment. The third column provides certain heuristic characteristics of each candidate speech segment. Note the heuristic characteristics of each candidate speech segment are provided only to aid the reader of the present disclosure in understanding the nature of the corresponding candidate speech segment when listened to in person. The heuristic characteristics are not required to be explicitly determined by any means, or otherwise explicitly provided for each candidate speech segment.

It will be appreciated that the four candidate speech segments shown in Table I offer a diversity of emotional content corresponding to the specified semantic content, in that each candidate speech segment has text content and heuristic characteristics that will likely provide the listener with a perceived emotional content distinct from the other candidate speech segments.

Note that Table I is shown for illustrative purposes only, and is not meant to limit the scope of the present disclosure to any particular parameters or characteristics shown in Table I. For example, the candidate speech segments need not have different text content from each other, and may all include identical text, with differing heuristic characteristics only. Furthermore, any number of candidate speech segments (e.g., more than four) may be provided. It will be appreciated that the number of candidate speech segments generated is a design parameter that may depend on, e.g., the effectiveness of block 410 in generating suitably diverse candidate speech segments, as well as processing and memory constraints of computer hardware implementing the processes described. Note there generally need not be any predetermined relationship between the different candidate speech segments, or any significance attributed to the sequence in which the candidate speech segments are presented.

Various techniques may be employed to generate a plurality of emotionally diverse candidate speech segments associated with a given semantic content. For example, in an exemplary embodiment, an emotionally neutral reading of a sentence may be generated, and the reading may then be post-processed to modify one or more speech parameters known to be correlated with emotional content. For example, the speed of a single candidate speech segment may be alternately set to fast and slow to generate two candidate speech segments. Other parameters to be varied may include, e.g., volume, rising or falling pitch, etc. In an alternative exemplary embodiment, crowd-sourcing techniques may be utilized to generate the plurality of emotionally diverse candidate speech segments, as further described hereinbelow with reference to FIG. 5.

Returning to FIG. 4, the plurality of emotionally diverse candidate speech segments 410*a* generated by block 410 is provided to a candidate selection block 412 for selecting the candidate speech segment most closely corresponding to a specified emotion type 312. Block 412 may implement any of a variety of algorithms designed to identify the emotion type of a speech segment. In an exemplary embodiment, as further described hereinbelow with reference to FIG. 6, block 412 may utilize an algorithm derived from machine learning techniques to classify or rank the plurality of candidate speech segments 410*a* according to consistency of a candidate's emotion type to the predetermined emotion type 312. In alternative exemplary embodiments, any techniques for discerning emotion type from a speech or text segment may be employed.

Further in FIG. 4, block 412 provides the identified optimal candidate speech segment 412*a* to a conversion to speech block 414, if necessary. In particular, in an exemplary embodiment wherein any candidate speech segment is in the form of text, then block 414 may convert such text to an audio waveform. In an exemplary embodiment wherein all candidate speech segments are already audio waveforms, then block 414 would not be necessary.

In an exemplary embodiment, as shown in FIG. 5, block 410 may be implemented as a look-up table (LUT) 410.1 that associates a plurality of emotionally diverse candidate speech segments 500 to a given semantic content 310. In FIG. 5, the specific semantic content or message 501*a* corresponding to "Red Sox have won World Series" is listed as a first input entry in LUT 410.1, while candidates 1 through N (also labeled 510*a*.1, 510*a*.2, . . . , 510*a*.N) are associated with entry 501*a* in LUT 410.1. For example, candidates 1 through N=4 may correspond to the four candidates identified in Table I.

Note the plurality of candidate speech segments (e.g., 510*a*.1 through 510*a*.N) for each entry in LUT 410.1 may be predetermined and stored in, e.g., memory local to device 120, or in memory accessible via a wired or wireless network remote from device 120. The determination of candidate speech segments associated with a given semantic content 310 may be performed, e.g., as described with reference to FIG. 6 hereinbelow.

In an exemplary embodiment, LUT 410.1 may correspond to a database, to which a module of block 410 submits a query requesting a plurality of candidates associated with a given message. Responsive to the query, the database returns a plurality of candidates having diverse emotional content associated with the given message. In an exemplary embodiment, block 410 may submit the query wirelessly to an online version of LUT 410.1 that is located, e.g., over a network, and LUT 410.1 may return the results of such query also over the network.

In an exemplary embodiment, block 412 may be implemented as, e.g., an algorithm that applies certain rules to rank a plurality of candidate speech segments to determine consistency with a specified emotion type 312. Such algorithm may be executed locally on device 120, or the results of the ranking may be accessible via a wired or wireless network remote from device 120.

It will be appreciated that using the architecture shown in FIG. 4, certain techniques of the present disclosure effectively transform a task (e.g., a "direct synthesis" task) of directly synthesizing a speech segment having an emotion type into an alternative task of: first, generating a plurality of candidate speech segments, and second, analyzing the plurality of candidates to determine which one comes closest to having the emotion type (e.g., "synthesis" followed by "analysis"). In certain cases, it will be appreciated that executing the synthesis-analysis task may be computationally simpler and also yield better results than executing the direct synthesis task, especially given the vast number of inter-dependent parameters that potentially contribute to the perceived emotional content of a given sentence.

Figure 6:
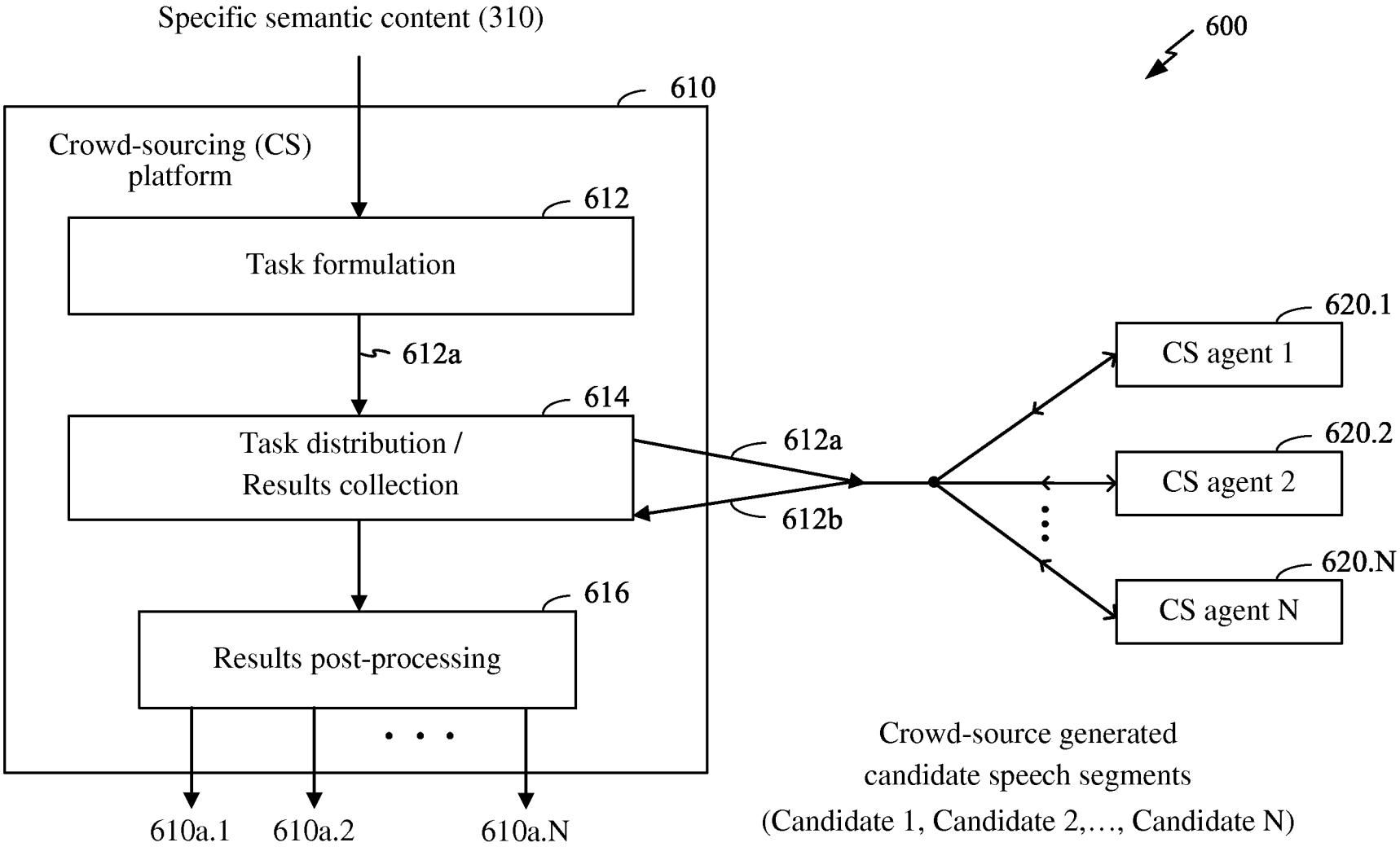
FIG. 6 illustrates an exemplary crowd-sourcing scheme for generating a plurality of emotionally diverse candidate speech segments given a specific semantic content.

FIG. 6 illustrates an exemplary crowd-sourcing scheme 600 for generating a plurality of emotionally diverse candidate speech segments given a specific semantic content. Note FIG. 6 is shown for illustrative purposes only, and is not meant to limit the scope of the present disclosure to any particular techniques for generating the plurality of candidate speech segments, or any particular manner of crowd-sourcing the tasks shown. In an exemplary embodiment, some or all of the functional blocks shown in FIG. 6 may be executed offline, e.g., to derive a plurality of candidates associated with each instance of semantic content, with the derived candidates stored in a memory later accessible in real-time.

In FIG. 6, semantic content 310 is provided to a crowd-sourcing (CS) platform 610. The CS platform 610 may include, e.g., processing modules configured to formulate and distribute a single task to multiple crowd-sourcing (CS) agents, each of which may independently perform the task and return the result to the CS platform 610. In particular, task formulation module 612 in CS platform 610 receives semantic content 310. Task formulation module 612 formulates, based on semantic content 310, a task of assembling a plurality of emotionally diverse candidate speech segments corresponding to semantic content 310.

The task 612*a* formulated by module 612 is subsequently provided to task distribution/results collection module 614. Module 614 transmits information regarding the formulated task 612*a* to crowd-sourcing (CS) agents 620.1 through 620.N. Each of CS agents 620.1 through 620.N may independently execute the formulated task 612*a*, and returns the results of the executed task to module 614. Note in FIG. 6, the results returned to module 614 by CS agents 620.1 through 620.N are collectively labeled 612*b*. In an exemplary embodiment, the results 612*b* may include a plurality of emotionally diverse candidate speech segments corresponding to semantic content 310. For example, results 612*b* may include a plurality of sound recording files, each independently expressing semantic content 310. In an alternative exemplary embodiment, results 612*b* may include a plurality of text messages (such as illustratively shown in column 2 of Table I hereinabove), each text message containing an independent textual formulation expressing semantic content 310. In yet another exemplary embodiment, results 612*b* may include a mix of sound recording files, text messages, etc., all corresponding to emotionally distinct expressions of semantic content 310.

In an exemplary embodiment, module 614 may interface with any or all of CS agents 620.1 through 620.N over a network, e.g., a plurality of terminals linked by the standard Internet protocol. In particular, any CS agent may correspond to one or more human users (not shown in FIG. 6) accessing the Internet through a terminal. A human user may, e.g., upon receiving the formulated task 612*a* from CS platform 610 over the network, execute the task 612*a* and provide a voice recording of a speech segment corresponding to semantic content 310. Alternatively, a human user may execute the task 612*a* by providing a text message formulation corresponding to semantic content 310. For instance, referring to the illustrative example described hereinabove wherein semantic content 310 corresponds to "The Red Sox have won the World Series," the CS agents may collectively or individually generate a plurality of candidate speech segments, including candidates #1, #2, #3, and #4 illustratively shown in Table I hereinabove. (Note in an actual implementation, the number of candidates obtained via crowd-sourcing may be considerably greater than four.)

Given the variety of distinct users participating as CS agents 620.1 through 620.N, it is probable that one of the expressions generated by the CS agents will closely correspond to the target emotion type 312, as may be subsequently determined by a module for identifying the optimal candidate speech segment, such as block 412 described with reference to FIG. 4. The techniques described thus effectively harness potentially vast computational resources accessible via crowd-sourcing for the task of generating emotionally diverse candidates.

Note CS agents 620.1 through 620.N may be provided with only the semantic content 310. The CS agents need not be provided with emotion type 312. In alternative exemplary embodiments, the CS agent may be provided with emotion type 312. In general, since it is not necessary to provide the CS agents with knowledge of the emotion type 312, the crowd-sourcing operations as shown in FIG. 6 may be performed offline, e.g., before the specification of emotion type 312 by dialog engine 240.1 in response to user speech input 122. For example, an LUT 410.1 with a suitably large number of input entries corresponding to various types of expected semantic content 310 may be specified, and associated emotionally diverse candidates 500 may be generated offline via crowd-sourcing and stored in LUT 410.1 prior to real-time operation of processing 200. In such an exemplary embodiment wherein candidates are determined a priori via offline crowd-sourcing, the universe of semantic content 310 that may be specified by dialog engine 240.1 will be finite. Note, however, that in exemplary embodiments of the present disclosure wherein the plurality of candidates are generated real-time (e.g., non-crowd-sourcing generation of candidates, or combinations of crowd-sourcing and other real-time techniques), the universe of semantic content 310 available to dialog engine 240.1 need not be so limited.

In view of the techniques disclosed herein, it will be appreciated that any techniques known for performing crowd-sourcing not explicitly described herein may generally be employed for the task of generating a plurality of emotionally diverse candidate speech segments for a given semantic content 310. For example, standard techniques for providing incentives to crowd-sourcing agents, for distributing tasks, etc., may be applied along with the techniques of the present disclosure. Such alternative exemplary embodiments are contemplated to be within the scope of the present disclosure.

Note while a plurality N of crowd-sourcing agents are shown in FIG. 6, alternative exemplary embodiments may employ a single crowd-sourcing agent for generating the plurality of candidate speech segments.

Figure 7:
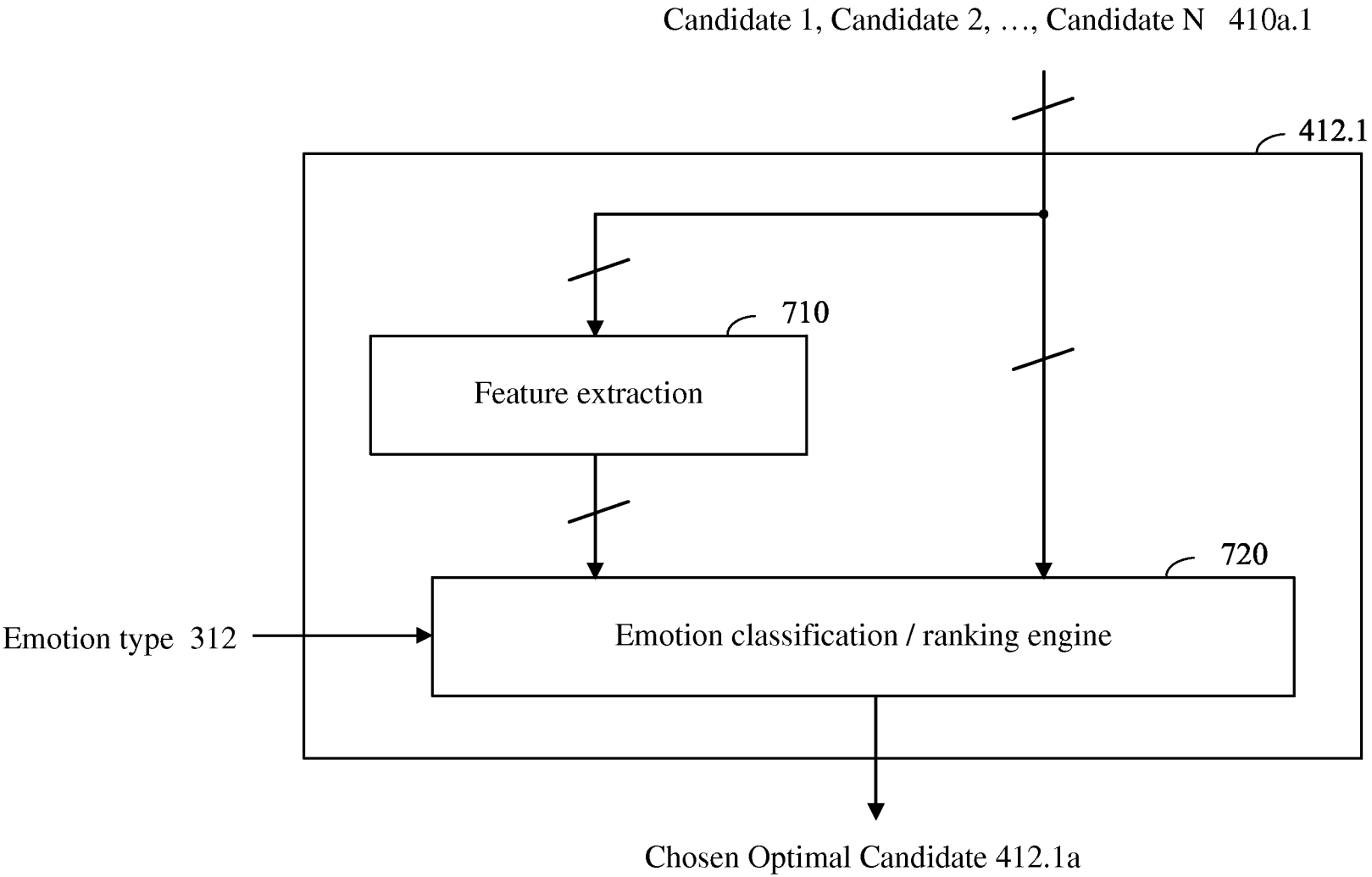
FIG. 7 illustrates an exemplary embodiment of a candidate selection block for identifying an optimal candidate speech segment most closely corresponding to a specified emotion type.

FIG. 7 illustrates an exemplary embodiment 412.1 of block 412 for identifying a candidate speech segment most closely corresponding to a predetermined emotion type 312. Note FIG. 7 is shown for illustrative purposes only, and is not meant to limit the scope of the present disclosure to any particular techniques for determining consistency of a candidate's emotional content with a predetermined emotion type.

In FIG. 7, a plurality N of candidate speech segments 410*a*.1 labeled Candidate 1, Candidate 2, . . . , Candidate N are provided as input to block 412.1. The candidates 410*a*.1 are provided to a feature extraction block 710, which extracts a set of features from each candidate that are relevant to the determination of each candidate's emotion type. Candidates 410*a*.1 are also provided to the emotion classification/ranking engine 720, along with predetermined emotion type 312. Engine 720 chooses an optimal candidate 412.1*a* from among the plurality of candidates 410*a*.1, based on an algorithm designed to classify or rank the candidates 410*a*.1 based on consistency of each candidate's emotional content to the specified emotion type 312.

In certain exemplary embodiments, the algorithm underlying engine 720 may be derived from machine learning techniques. For example, in a classification-based approach, the algorithm may determine, for every candidate, whether it is or is not of the given emotion type. In a ranking-based approach, the algorithm may rank all candidates in order of their consistency with the predetermined emotion type.

While certain exemplary embodiments of block 412 are described herein with reference to machine-learning based techniques, it will be appreciated that the scope of the present disclosure need not be so limited. Any algorithms for assessing the emotion type of candidate text or speech segments may be utilized according to the techniques of the present disclosure. Such alternative exemplary embodiments are contemplated to be within the scope of the present disclosure.

Figure 8:
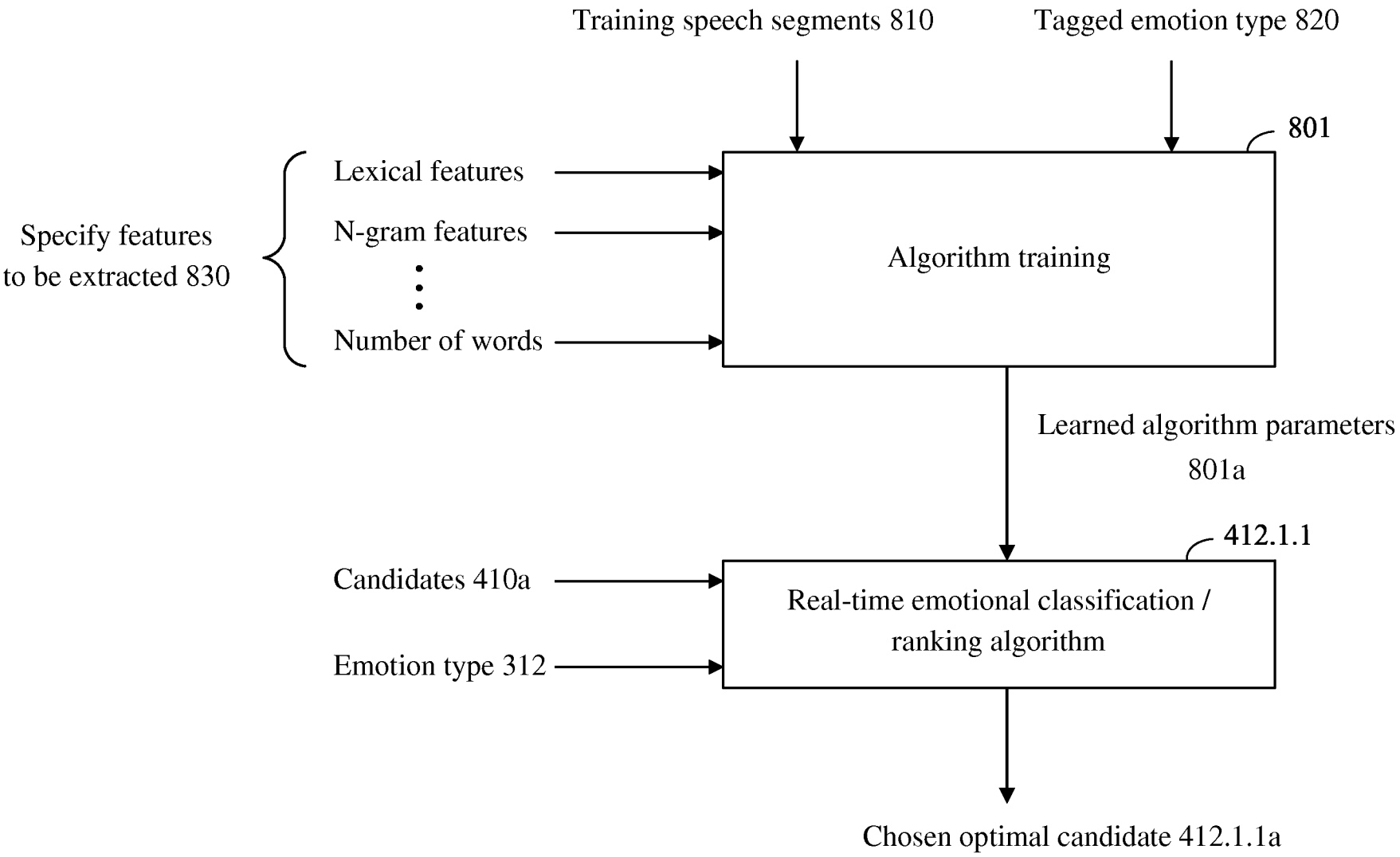
FIG. 8 illustrates an exemplary embodiment of machine-learning techniques for deriving an algorithm used in an emotion classification/ranking engine.

FIG. 8 illustrates an exemplary embodiment of machine-learning techniques for deriving an algorithm used in emotion classification/ranking engine 720. Note FIG. 8 is shown for illustrative purposes only, and is not meant to limit the scope of the present disclosure to algorithms derived from machine-learning techniques.

In FIG. 8, training speech segments 810 are provided with corresponding tagged emotion type 820 to algorithm training block 801. Training speech segments 810 may include a large enough sample of speech segments to enable algorithm training 801 to derive a set of robust parameters for driving the emotional classification/ranking algorithm. Tagged emotion type 820 labels the emotion type of each of training speech segments 810 provided to algorithm training block 801. Such labels may be derived from, e.g., human input or other sources.

In an exemplary embodiment, crowd-sourcing scheme 600 may be utilized to derive the training inputs, e.g., training speech segments 810 and tagged emotion type 820. For example, any of CS agents 620.1 through 620.N may be requested to provide a tagged emotion type 820 corresponding to the speech segment generated by that CS agent.

Algorithm training block 801 may further accept a list of features to be extracted 830 from speech segments 810 relevant to the determination of emotion type. Based on the list of features, algorithm training block 801 may derive dependencies amongst the features 830 and the tagged emotion type 820 that most correctly match the training speech segments 810 to their corresponding predetermined emotion type 820 over the entire sample of training speech segments 810. Similar machine learning techniques may also be applied to, e.g., text segments, and/or combinations of text and speech. Note techniques for algorithm training in machine learning may include, e.g., Bayesian techniques, artificial neural networks, etc. The output of algorithm training block 801 includes learned algorithm parameters 801*a*, e.g., weights or other specified dependencies to estimate the emotion type 820 of an arbitrary speech segment.

In certain exemplary embodiments, the features to be extracted 830 from speech segments 810 may include (but are not restricted to) any combination of the following:

1. Lexical features. Each word in a speech segment may be a feature.

2. N-gram features. Each sequence of N-words, where N ranges from 2 to any arbitrarily large integer, in a sentence may be a feature.

3. Language model score. Based on raw sentences and/or speech segments for each predetermined emotion type, language models may be trained to recognize the raw sentences and/or speech segments as corresponding to the predetermined emotion type. The score assigned to a sentence by the language model of the given emotion type may be a feature. Such language models may include those used in statistical natural language processing (NLP) tasks such as speech recognition, machine translation, etc., wherein, e.g., probabilities are assigned to a particular sequence of words or N-grams. It will be appreciated that the language model score may enhance the accuracy of emotion type assessment.

4. Topic model score. Based on raw sentences and/or speech segments for each predetermined emotion type, topic models may be trained to recognize the raw sentences and/or speech segments as corresponding to a topic. The score assigned to a sentence by the topic model may be a feature. Topic modeling may utilize, e.g., latent semantic analysis techniques.

5. Word embedding. Word embedding may correspond to a neural network-based technique for mapping a word to a real-valued vector, wherein vectors of semantically related words may be geometrically close to each other. The word embedding feature can be used to convert sentences into real-valued vectors, according to which sentences with the same emotion type may be clustered together.

6. Number of words. The word count, e.g., normalized word count, of a sentence may be a feature.

7. Number of clauses. The normalized count of clauses in each sentence may be a feature. A clause may be defined, e.g., as a smallest grammatical unit that can express a complete proposition. The proposition may generally include a verb and possible arguments, which are then identifiable by algorithms.

8. Number of personal pronouns. The normalized count of personal pronouns (such as "I," "you," "me," etc.) in a sentence may be a feature.

9. Number of emotional/sentimental words. The normalized count of emotional words (e.g., "happy," "sad," etc.) and sentimental words (e.g., "like," "good," "awful," etc.) may be features.

10. Number of exclamation words. The (normalized) count of exclamation words (e.g., "oh," "wow," etc.) may be a feature.

Note the preceding list of features is provided for illustrative purposes only, and is not meant to limit the scope of the present disclosure to any particular features enumerated herein. One of ordinary skill in the art will appreciate that other features not explicitly disclosed herein may readily be extracted and utilized for the purposes of the present disclosure. Exemplary embodiments incorporating such alternative features are contemplated to be within the scope of the present disclosure.

Learned algorithm parameters 801*a* are provided to real-time emotional classification/ranking algorithm 412.1.1. In an exemplary embodiment, configurable parameters of the real-time emotional classification/ranking algorithm 412.1.1 may be programmed to the learned settings 801*a*. Based on the learned parameters 801*a*, algorithm 412.1.1 may, in an exemplary embodiment, classify each of candidates 410*a* according to whether they are consistent with the predetermined emotion type 312. Alternatively, algorithm 412.1.1 may rank candidates 410*a* in order of their consistency with the predetermined emotion type 312. In either case, algorithm 412.1.1 may output an optimal candidate 412.1.1*a* most consistent with the predetermined emotion type 312.

Figure 9:
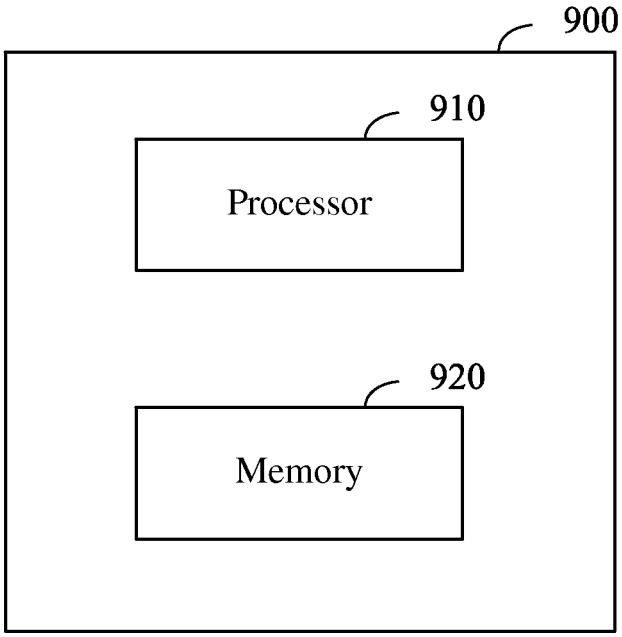
FIG. 9 schematically shows a non-limiting computing system that may perform one or more of the above described methods and processes.

FIG. 9 schematically shows a non-limiting computing system 900 that may perform one or more of the above described methods and processes. Computing system 900 is shown in simplified form. It is to be understood that virtually any computer architecture may be used without departing from the scope of this disclosure. In different embodiments, computing system 900 may take the form of a mainframe computer, server computer, desktop computer, laptop computer, tablet computer, home entertainment computer, network computing device, mobile computing device, mobile communication device, smartphone, gaming device, etc.

Computing system 900 includes a processor 910 and a memory 920. Computing system 900 may optionally include a display subsystem, communication subsystem, sensor subsystem, camera subsystem, and/or other components not shown in FIG. 9. Computing system 900 may also optionally include user input devices such as keyboards, mice, game controllers, cameras, microphones, and/or touch screens, for example.

Processor 910 may include one or more physical devices configured to execute one or more instructions. For example, the processor may be configured to execute one or more instructions that are part of one or more applications, services, programs, routines, libraries, objects, components, data structures, or other logical constructs. Such instructions may be implemented to perform a task, implement a data type, transform the state of one or more devices, or otherwise arrive at a desired result.

The processor may include one or more processors that are configured to execute software instructions. Additionally or alternatively, the processor may include one or more hardware or firmware logic machines configured to execute hardware or firmware instructions. Processors of the processor may be single core or multicore, and the programs executed thereon may be configured for parallel or distributed processing. The processor may optionally include individual components that are distributed throughout two or more devices, which may be remotely located and/or configured for coordinated processing. One or more aspects of the processor may be virtualized and executed by remotely accessible networked computing devices configured in a cloud computing configuration.

Memory 920 may include one or more physical devices configured to hold data and/or instructions executable by the processor to implement the methods and processes described herein. When such methods and processes are implemented, the state of memory 920 may be transformed (e.g., to hold different data).

Memory 920 may include removable media and/or built-in devices. Memory 920 may include optical memory devices (e.g., CD, DVD, HD-DVD, Blu-Ray Disc, etc.), semiconductor memory devices (e.g., RAM, EPROM, EEPROM, etc.) and/or magnetic memory devices (e.g., hard disk drive, floppy disk drive, tape drive, MRAM, etc.), among others. Memory 920 may include devices with one or more of the following characteristics: volatile, nonvolatile, dynamic, static, read/write, read-only, random access, sequential access, location addressable, file addressable, and content addressable. In some embodiments, processor 910 and memory 920 may be integrated into one or more common devices, such as an application specific integrated circuit or a system on a chip.

Memory 920 may also take the form of removable computer-readable storage media, which may be used to store and/or transfer data and/or instructions executable to implement the herein described methods and processes. Removable computer-readable storage media 930 may take the form of CDs, DVDs, HD-DVDs, Blu-Ray Discs, EEPROMs, and/or floppy disks, among others.

It is to be appreciated that memory 920 includes one or more physical devices that stores information. The terms "module," "program," and "engine" may be used to describe an aspect of computing system 900 that is implemented to perform one or more particular functions. In some cases, such a module, program, or engine may be instantiated via processor 910 executing instructions held by memory 920. It is to be understood that different modules, programs, and/or engines may be instantiated from the same application, service, code block, object, library, routine, API, function, etc. Likewise, the same module, program, and/or engine may be instantiated by different applications, services, code blocks, objects, routines, APIs, functions, etc. The terms "module," "program," and "engine" are meant to encompass individual or groups of executable files, data files, libraries, drivers, scripts, database records, etc.

In an aspect, computing system 900 may correspond to a computing device including a memory 920 holding instructions executable by a processor 910 to retrieve a plurality of speech candidates having semantic content associated with a message, and select one of the plurality of speech candidates corresponding to a specified emotion type. The memory 920 may further hold instructions executable by processor 910 to generate speech output corresponding to the selected one of the plurality of speech candidates. Note such a computing device will be understood to correspond to a process, machine, manufacture, or composition of matter.

Figure 10:
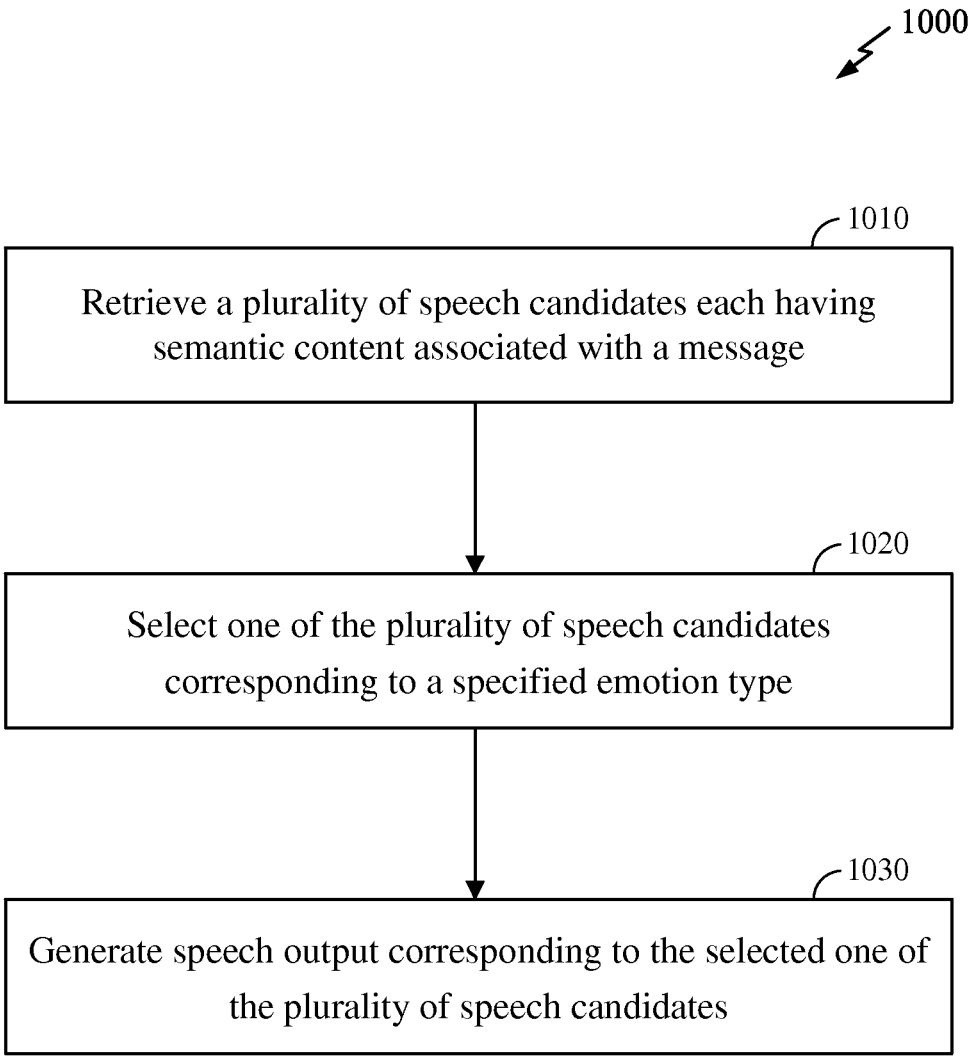
FIG. 10 illustrates an exemplary embodiment of a method according to the present disclosure.

FIG. 10 illustrates an exemplary embodiment of a method 1000 according to the present disclosure. Note FIG. 10 is shown for illustrative purposes only, and is not meant to limit the scope of the present disclosure to any particular method shown.

In FIG. 10, at block 1010, the method retrieves a plurality of speech candidates each having semantic content associated with a message.

At block 1020, one of the plurality of speech candidates corresponding to a specified emotion type is selected.

At block 1030, speech output corresponding to the selected one of the plurality of candidates is generated.

In this specification and in the claims, it will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Furthermore, when an element is referred to as being "electrically coupled" to another element, it denotes that a path of low resistance is present between such elements, while when an element is referred to as being simply "coupled" to another element, there may or may not be a path of low resistance between such elements.

The functionality described herein can be performed, at least in part, by one or more hardware and/or software logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

The invention claimed is:

1. An apparatus for generating audio responses to an audio query from a user that are tailored based on emotions of the audio query, the apparatus comprising:

a content and emotion type specification block configured to:

receive a speech input comprising a query from a user, convert the speech input of the query from the user to text, and identify sematic content and an emotion type of the query from the text, a candidate generation block configured to retrieve a plurality of emotionally diverse speech waveform candidates, each having the specified semantic content, that answer the query specified in the text;

a candidate selection block configured to select one of the plurality of candidates answering the query and corresponding to the emotion type through word embedding features of the plurality of candidates, the word embedding features comprising text of the plurality of candidates converted to vectors that are used to identify corresponding emotion types of the plurality of candidates through clustering of the vectors relative to the emotion types; and a speaker for generating an audio output answering the query and matching the emotion type from the plurality of candidates.

2. The apparatus of claim 1, wherein the candidate generation block is configured to retrieve the plurality of emotionally diverse speech waveform candidates through:

submitting the text of the query to a look-up table, wherein the message is an input entry of the look-up table; and receiving from the look-up table a plurality of candidates associated with the message.

3. The apparatus of claim 2, wherein the candidate generation block is configured to submit the query wirelessly to an online look-up table.

4. The apparatus of claim 1, wherein the plurality of emotionally diverse speech waveform candidates associated with a message includes at least two audio waveforms having different speeds of delivery.

5. The apparatus of claim 1, further comprising:

a speech recognition block; and a language understanding block;

the content and emotion type specification block comprising a dialog engine configured to generate a message having the specified semantic content and the emotion type.

6. The apparatus of claim 1, the candidate selection block configured to extract at least one feature from each of the plurality of emotionally diverse speech waveform candidates, the at least one feature additionally comprising a language model score or a topic model score.

7. The apparatus of claim 1, wherein the plurality of emotionally diverse speech waveform candidates are generated for each message by varying at least one speech parameter of each candidate correlated with emotional content.

8. A method, comprising:

receiving a speech input comprising a query from a user;

converting the speech input of the query from the user to text;

identifying semantic content and an emotion type of the query from the text;

retrieving a plurality of emotionally diverse speech waveform candidates, each having the specific semantic content, that answer the query specified in the text;

determining emotion types of the emotionally diverse speech waveform candidates using word embedding features of the emotionally diverse speech waveform candidates, the word embedding features comprising text of the emotionally diverse speech waveform candidates converted to vectors that are used to identify the emotion types through clustering of the vectors relative to the emotion types;

selecting one of the plurality of the emotionally diverse speech waveform candidates answering the query and corresponding to the emotion type of the query based, at least in part, on the emotion types of the emotionally diverse speech waveform candidates determined using the word embedding features; and generating speech output answering the query and corresponding to the selected one of the plurality of candidates.

9. The method of claim 8, wherein said retrieving the plurality of emotionally diverse speech waveform candidates comprises:

submitting the message as a query to a look-up table, wherein the message is an input entry of the look-up table; and receiving from the look-up table a plurality of candidates associated with the message.

10. The method of claim 8, wherein the plurality of emotionally diverse speech waveform candidates is associated with a message includes at least two sentences having differing lexical content.

11. The method of claim 8, wherein the plurality of emotionally diverse speech waveform candidates is associated with a message includes at least two audio waveforms having different speeds of delivery.

12. The method of claim 8, wherein said selecting the one of the plurality of candidates answering the query comprises:

classifying each of the plurality of candidates according to whether the candidate is consistent with the specified emotion.

13. The method of claim 8, further comprising:

receiving speech input;

recognizing the speech input;

understanding a language of the recognized speech input; and generating the message associated with the plurality of candidates and the specified emotion type based on the understood language.

14. A computing device for electronically synthesizing speech, the computing device including a memory holding instructions executable by a processor to perform operations, comprising:

receiving a speech input comprising a query from a user;

converting the speech input of the query from the user to text;

identifying semantic content and an emotion type of the query from the text;

identifying semantic content and an emotion type of the query from the text;

retrieving a plurality of emotionally diverse speech waveform candidates, each having the specified semantic content, that answer the query specified in the text;

determining emotion types of the emotionally diverse speech waveform candidates using word embedding features of the emotionally diverse speech waveform candidates, the word embedding features comprising text of the emotionally diverse speech waveform candidates converted to vectors that are used to identify the emotion types through clustering of the vectors relative to the emotion types;

selecting one of the plurality of the emotionally diverse speech waveform candidates answering the query and corresponding to the emotion type of the query based, at least in part, on the emotion types of the emotionally diverse speech waveform candidates determined using the word embedding features; and generate speech output answering the query and corresponding to the selected one of the plurality of candidates.

15. The apparatus of claim 1, the plurality of emotionally diverse speech waveform candidates generated by crowdsourcing.

16. The method of claim 8, the plurality of emotionally diverse speech waveform candidates generated by crowdsourcing.

17. The device of claim 14, the plurality of emotionally diverse speech waveform candidates generated by crowdsourcing.

18. The computing device of claim 14, the instructions executable by the processor to specify semantic content and predetermined emotion type further comprising instructions executable by the processor to generate a message having the specified semantic content and the predetermined emotion type.

* * * * *